US012807195B2

(12) United States Patent
Taine et al.

(10) Patent No.: US 12,807,195 B2
(45) Date of Patent: Nov. 24, 2026

(54) SEALING SYSTEM, ASSEMBLY AND VEHICLE COMPRISING SUCH A SEALING SYSTEM AND METHOD FOR ASSEMBLING A VEHICLE COMPRISING SUCH A SEALING SYSTEM

(71) Applicant: ALSTOM Holdings, St Ouen sur Seine (FR)

(72) Inventors: Antoine Taine, Semeac (FR); Laurent Duffau, Lannemezan (FR); Nicolas Quentin, Ibos (FR)

(73) Assignee: ALSTOM HOLDINGS, Saint-Ouen-sur-Seine (FR)

( * ) Notice: Subject to any disclaimer, the term of this patent is extended or adjusted under 35 U.S.C. 154(b) by 487 days.

(21) Appl. No.: 18/491,156

(22) Filed: Oct. 20, 2023

(65) Prior Publication Data

US 2024/0132122 A1 Apr. 25, 2024
US 2024/0227878 A9 Jul. 11, 2024

(30) Foreign Application Priority Data

Oct. 24, 2022 (EP) ..... 22306610

(51) Int. Cl.
*B61D 49/00* (2006.01)

(52) U.S. Cl.
CPC ..... *B61D 49/00* (2013.01)

(58) Field of Classification Search
CPC . B61D 49/00; B61D 17/12; F16J 3/041; F16J 3/042; B61C 17/00
See application file for complete search history.

(56) References Cited

FOREIGN PATENT DOCUMENTS

| | | | | |
|---|---|---|---|---|
| CN | 208541721 U | * | 2/2019 | ..... B61D 49/00 |
| DE | 102019110229 A1 | | 10/2020 | |
| EP | 2077216 A1 | * | 7/2009 | ..... B60H 1/00371 |
| ES | 177258 U | | 9/1972 | |
| RU | 2529453 C2 | | 9/2014 | |
| WO | 2009/144060 A1 | | 12/2009 | |

OTHER PUBLICATIONS

European Search Report issued in European Patent Application No. 22306610.1 dated Mar. 17, 2023 in 7 pages.

* cited by examiner

*Primary Examiner* — Scott A Browne
(74) *Attorney, Agent, or Firm* — Knobbe, Martens, Olson & Bear, LLP

(57) ABSTRACT

A sealing system can be mounted between a body of a vehicle and a box fastened to the body. The body and the box include a first opening and a second opening, respectively, opposite each other. The sealing system surrounds the passage and includes a bellows having a first end in contact with the body so as to surround the first opening, and a second end in contact with the box so as to surround the second opening. The sealing system comprises a compression spring. Each end of the spring acts on one of the two ends of the bellows so that the spring moves the two ends of the bellows away from each other.

12 Claims, 4 Drawing Sheets

SEALING SYSTEM, ASSEMBLY AND VEHICLE COMPRISING SUCH A SEALING SYSTEM AND METHOD FOR ASSEMBLING A VEHICLE COMPRISING SUCH A SEALING SYSTEM

CROSS-REFERENCE TO RELATED APPLICATION

This application claims priority to European Patent Application No. EP 22306610.1 filed on Oct. 24, 2022, the disclosure of which including the specification, the drawings, and the claims is hereby incorporated by reference in its entirety.

FIELD OF THE INVENTION

The present invention relates to an assembly comprising a sealing system and a box, a vehicle comprising such an assembly, and a method of assembly a vehicle comprising such an assembly.

BACKGROUND OF THE INVENTION

In the field of vehicles, and in particular of railway vehicles, it is known how to fasten a box to the body of a vehicle, the box being intended for accommodating equipment of the vehicle. It is also known how to provide a passage between the box and the body, for connecting the inside of the box to the inside of the body, to give access to the equipment arranged inside the box, from the inside of the body, e.g. for maintenance operations on the equipment. Such passage is formed by producing a first opening provided in the box and a second opening provided in the box and arranged opposite the first opening.

It is also known how to arrange a sealing bellows around the passage, so as to isolate the passage from the outside, to prevent water infiltrations inside the body and the box, which could come e.g. from precipitation or from cleaning operations from the outside of the vehicle. Such a bellows has a first end, fastened in a sealed way to the body, around the first opening, and a second end, fastened in a sealed way to the box, around the second opening. The ends of the bellows are fastened by fasteners which are generally flanges or clamps.

However, the use of flanges or clamps carries significant risks for the operator performing the fastening of the ends of the bellows. Indeed, the implementation of such fastenings requires access to the first and second openings, before the box is fastened to the vehicle body. Thereby, such a bellows is generally fastened while the box is being lifted, by being held above the body and at a distance from the body, so as to give the operator access to the first and second openings for the installation of the flanges or clamps. After fastening the bellows, the box is placed on the body and then fastened to the body.

The fastening of the bellows thus necessarily takes place under a load being lifting, which is particularly dangerous. Furthermore, the space left free between the box and the body is generally small, which makes the fastening of the bellows ends complex and time-consuming.

SUMMARY OF THE INVENTION

The present invention intends more particularly to overcome such drawbacks, by proposing a simpler sealing system, safer to install.

To this end, the invention relates to an assembly intended for being fastened to a body of a vehicle, in particular a railway vehicle, the vehicle body comprising a first opening. The assembly comprises a box and a sealing system fastened to the box. The box comprises a second opening delimited by an edge, the box being intended for being positioned on the body in a such a way that the first opening and the second opening face each other and form a passage between the inside of the body and the inside of the box, the sealing system being configured for surrounding the passage. The sealing system comprises a bellows having a first end configured for being in contact with the body, so as to surround the first opening, and a second end configured for being contact with the box; so as to surround the second opening. The sealing system comprises a compression spring extending along an axis and having two ends, each end of the compression spring acting on one of the two ends of the bellows so that the compression spring moves the two ends of the bellows apart, along the axis. The bellows comprises fasteners, the second end of the bellows being fastened by the fasteners to the edge delimiting the second opening.

Due to the assembly of the invention, the sealing system can be used for sealing a passage between the inside of the box intended for being fastened to a vehicle body and the inside of the vehicle body, without having to resort to fasteners requiring intervention under a load being lifted, and more precisely without requiring the sealing system to be fastened to the vehicle body, since the compression spring, by moving the two ends of the bellows apart, automatically presses the ends of the box around the openings of the body and of the box. Thereby, the assembly of a vehicle comprising such an assembly is made safe and easy.

According to advantageous but non-mandatory aspects of the invention, such an assembly incorporates one or a plurality of the following features, taken individually or according to any technically permissible combination:

- The sealing system comprises two washers, each washer being held between one end of the compression spring and one end of the bellows.
- At least one of the two ends of the bellows comprises at least one sealing rib intended for being compressed against the body or against the box.
- The spring is arranged inside the bellows.
- The spring has a stiffness comprised between 1,000 N/m and 10,000 N/m, preferentially a stiffness equal to 5,000 N/m.
- The fasteners are a peripheral collar flange, extending through the second opening, so as to hold the edge between the collar flange and the second end of the bellows.

According to a second aspect, the invention further relates to a vehicle, in particular a railway vehicle, including a body comprising a first opening, a box comprising a second opening, the box being fastened to the body and positioned on the body in such a way that the first opening and the second opening face each other and form a passage between the inside of the body and the inside of the box, and a sealing system surrounding the passage, wherein the box and the sealing system form an assembly as described hereinabove, wherein the box is fastened to the body in such a way as to compress the compression spring between the box and the body, the compression spring pressing the first end of the bellows against the body and pressing the second end of the bellows against the box.

Advantageously, in such vehicle, the compression spring exerts, on each of the two ends of the bellows, forces comprised between 50 N and 500 N, preferentially equal to 200 N.

According to a third aspect, the invention further relates to a method of assembly a vehicle, in particular a railway vehicle, the vehicle comprising a body comprising a first opening, a box comprising a second opening, and a sealing system, the box and the sealing system forming an assembly as described hereinabove, wherein the method for assembling the vehicle includes at least steps of:

a) fastening the sealing system to the box, using the fasteners,
b) positioning the box on the body and positioning the sealing system between the box and the body, so as to:
   position the second opening opposite the first opening;
   surround a passage between the two openings with the sealing system; and
   connect the first end of the bellows to the body and the second end of the bellows to the box, then
c) fastening the box to the body, leading to the sealing system to be held in position between the box and the body by compressing the compression spring thereof.

Such vehicle and such method of assembly lead to the same advantages as the advantages mentioned hereinabove with regard to the assembly of the invention.

BRIEF DESCRIPTION OF THE DRAWINGS

The invention will be better understood and other advantages of the invention will appear more clearly in the light of the following description of an embodiment of a sealing system, of a box, of a vehicle and of a method for assembling a vehicle, according to the principle thereof, given only as an example and made with reference to the enclosed drawings, wherein.

DETAILED DESCRIPTION OF THE PREFERRED EMBODIMENTS

Figure 1:
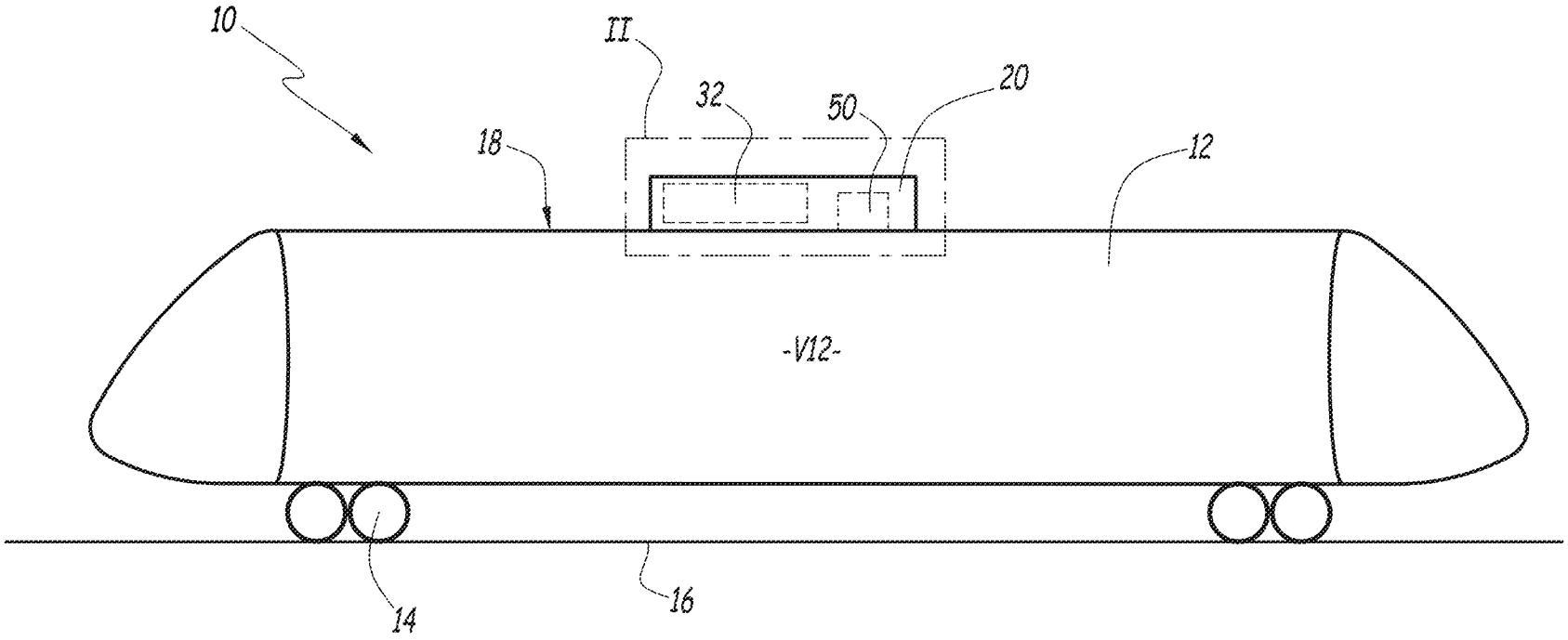
FIG. 1 is a side view of a railway vehicle according to the invention.

A railway vehicle 10 is shown in FIG. 1. The railway vehicle 10 comprises a body 12, delimiting an internal volume V12, and comprises wheels 14 enabling the vehicle to move on rails 16. The body 12 has a roof 18. In the example, the railway vehicle 10 is a single-car train.

Figure 2:
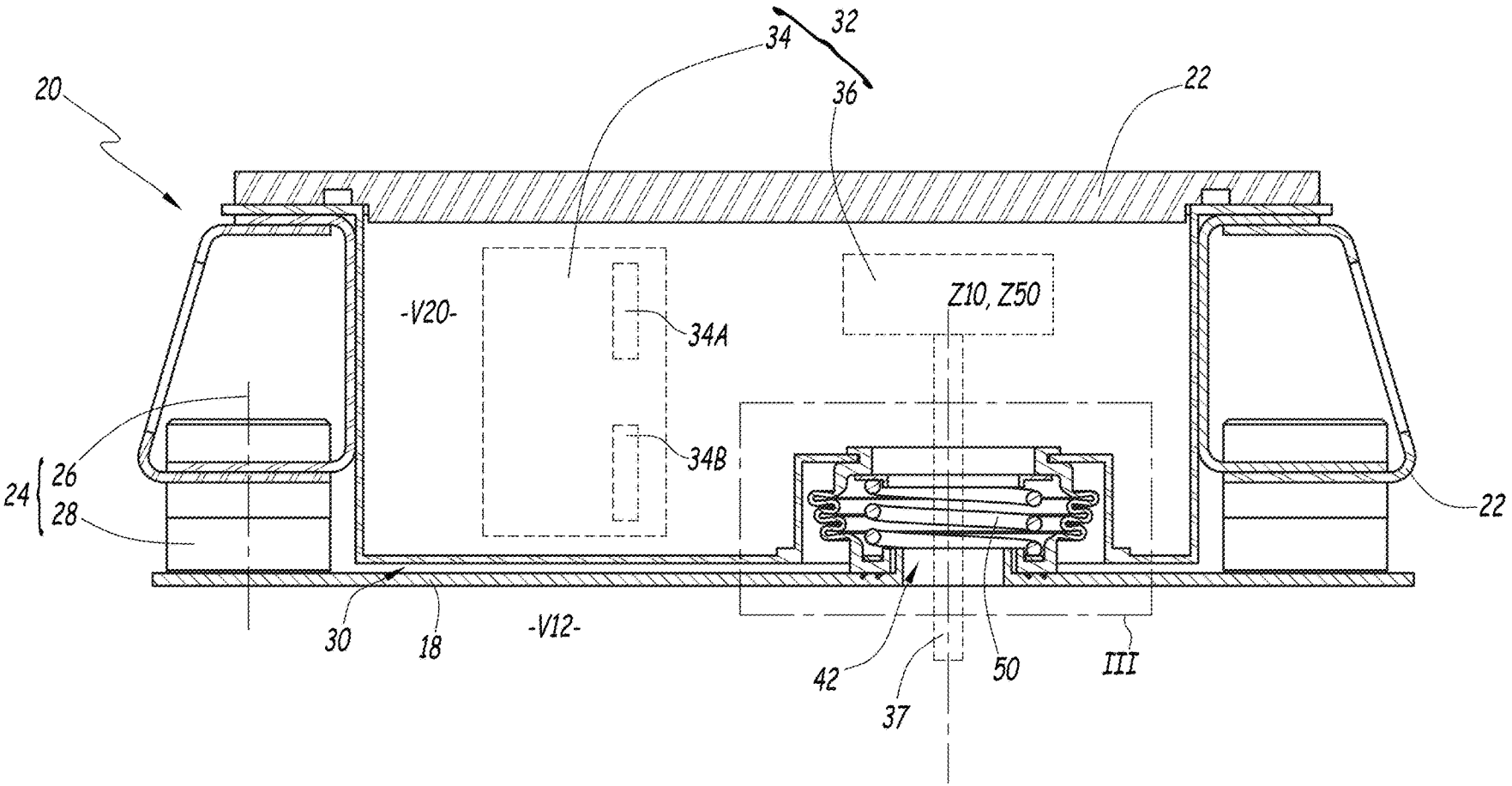
FIG. 2 is a longitudinal section at a greater scale of the detail II shown in FIG. 1.

As can be seen more clearly in FIG. 2, the railway vehicle 10 comprises a box 20, which is fastened to the body 12. A structure 22 of the box 20 delimits an internal volume V20. In the example, the box 20 is fastened to the roof 18 of the body. The box 20 is shown in a simplified manner in FIG. 1.

The box 20, and more precisely the structure 22 of the box, is fastened to the roof 18 by means of fasteners 24. In the example, the fasteners 24 comprise screws 26, represented in a simplified manner by axis lines, and shock absorbing bushings 28, also known as "silent blocks". In practice, the shock absorbing bushings 28 are arranged between the structure 22 and the roof 18 and are compressed by the tightening of the screws 26. Thus, the structure 22 of the box 20 is not directly in contact with the body 12, i.e. that a gap 30 is present between the box and the body, leads to reducing the transmission of vibrations and of noise between the box and the body. In addition, fastening the box to the roof using shock absorbing bushings makes possible a relatively small amplitude movement of the box with respect to the body, which also contributes to reducing vibration and noise transmissions between the box and the body.

The box 20 comprises equipment 32 which take part in the operation of the vehicle 10.

For example, the equipment 32 comprises a single-phase circuit breaker 34, one input 34A of which is connected to a power source (not shown) of the vehicle 10, such as a pantograph, and one output 34B of which is connected to a power train of the vehicle (also not shown), as well as a disconnector 36 which is a safety system for connecting the input and the output of the single-phase circuit breaker 34 to earth, in particular during maintenance operations on the vehicle. In practice, the disconnector 36 is a manually controlled mechanical disconnector which can be actuated by means of a crank 37 between a rest position and a disconnection position. In the figures, the equipment 32, the circuit breaker 34 and the disconnector 36 are shown schematically. The crank 37 is shown only in FIG. 3, in a simplified manner.

In a variant, the equipment 32 is e.g., traction equipment, or any other electrical equipment comprising an element which can be actuated by manual means.

The roof 18 of the body 12 comprises a first opening 38, delimited by an edge 39 of the roof, and the box 20 comprises a second opening 40, delimited by an edge 41 of the structure 22. The box 20 is mounted on the roof 18 in such a way that the first opening 38 and the second opening 40 face each other, forming therebetween a passage 42 which connects the interior volume V12 of the body to the interior volume V20 of the box. In other words, the interior volume V20 of the box 20 is accessible from the interior volume V12 of the body 12, via the passage 42. In the example, the edges 39 and 41 delimit openings 38 and 40 with circular shape and the passage 42 is cylindrical with a circular base and extends along an axis Z10, which is herein vertical.

The passage 42 is particularly useful for facilitating the access to the equipment 32. Thereby, the disconnector 36 is operated from the interior volume V12 of the body 12, by inserting the crank 37 through the passage 42 from the inside of the body until reaching the disconnector, i.e. by inserting the crank 37 through the first opening 38 and then through the second opening 40.

H1 denotes the height of the passage 42, measured along the axis Z10. Thereby, the height H1 corresponds to the distance separating the roof 18 from the box 20, at the openings 38 and 40.

The vehicle 10 comprises a sealing system 50, mounted between the box 20 and the body 12 so as to surround the passage 42. The sealing system 50 provides sealing between the interior volumes V12 and V20 and the outside of the vehicle 10. In other words, the sealing system 50 provides sealing between the passage 42 and the outside of the vehicle 10, and more precisely between the passage 42 and the gap 30.

Figure 3:
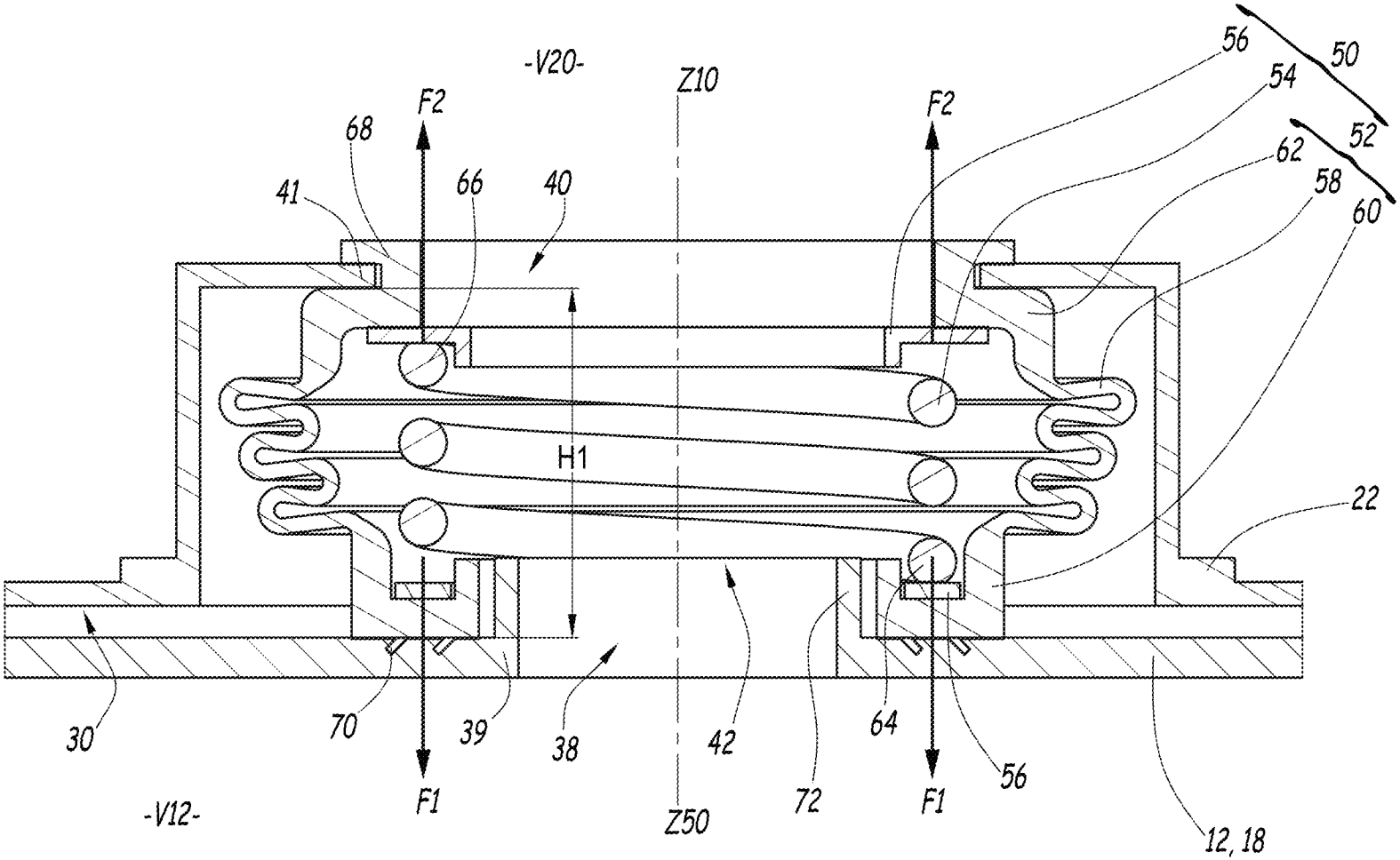
FIG. 3 is a view of the detail III shown in FIG. 2.

As can be seen more clearly in FIG. 3, the sealing system 50 comprises a bellows 52, a compression spring 54 and, advantageously, two washers 56.

The bellows 52 extends along an axis Z50 which coincides with the axis Z10 in the assembled configuration of the vehicle 10. The bellows 52 comprises a concertina wall 58 which extends along the axis Z50 and which is extendable and compressible along the axis Z50. The wall 58 is solid and sealed. The bellows 52 comprises a first end 60 and a second end 62, connected therebetween by the concertina wall 58. The two ends 60 and 62 are open. In the example, the bellows 52 has a symmetry of revolution about the axis Z50 and the two ends 60 and 62 have a circular shape.

In order for the extending and the compression of the concertina wall 58 to take place, the bellows 52 is made of a flexible material, such as e.g. silicone.

The compression spring 54 extends along the axis Z50, being coaxial with the bellows 52, and has a first end 64 and a second end 66. Preferentially, the compression spring 54 is made of a metallic material, e.g. spring steel. In the example, the compression spring 54 is a helical spring, made from a wire with a round cross-section. In a variant, the compression spring 54 is made from a wire with another section, such as e.g. a rectangular or an elliptical cross-section. In a variant, the compression spring is a conical spring, a volute spring, or any other type of compression spring.

Preferentially, the stiffness of the compression spring 54 is comprised between 1,000 N/m and 10,000 N/m, more preferentially equal to 5,000 N/m.

The compression spring 54 is arranged in the bellows 52 so that the ends 64 and 66 of the spring act on the ends 60 and 62 of the bellows 52 so as to move the two ends of the bellows apart along the axis Z50. In other words, the first end 64 of the compression spring 54 exerts a force F1 on the first end 60 of the bellows, the second end 66 of the compression spring exerts a force F2 on the second end 62 of the bellows, and the forces F1 and F2 are directed parallel to the axis Z50 and oppose each other.

A first washer 56 is arranged between the first end 60 of the bellows and the first end 64 of the spring and the second washer 56 is arranged between the second end 62 of the bellows and the second end 66 of the spring. In other words, the washers 56 are inserted in-between the ends 64 and 66 of the spring 54 and the ends 60 and 62 of the bellows 52.

In a particularly advantageous way, the washers 56 are used for protecting the ends 60 and 62 of the bellows 52, by preventing the direct contact of the ends with the compression spring 54, since direct contact could damage the bellows, in particular when the bellows is made of a material which is more flexible than the material of the compression spring, e.g. silicone, whereas the compression spring is made of spring steel. In addition, the washers 56 lead to a more homogeneous transmission of the forces F1 and F2 from the ends 64 and 66 of the compression spring to the ends 60 and 62 of the bellows. Indeed, the washers 56 can e.g., compensate for surface defects on the ends of the compression spring.

The sealing system 50 is fastened to the box 20, and more precisely to the structure 22 of the box, in such a way that the second end 62 of the bellows 52 is in contact with the structure 22 of the box 20, surrounding the second opening 40. For this purpose, the bellows 52 comprises fasteners 68 for fastening the second end 62 of the bellows to the edge 41 of the structure 22.

In the example, the fasteners 68 are a peripheral collar flange, which extends from the second end 62 of the bellows 52 through the second opening 40 to the interior volume V20 of the box 20, and which holds the edge between the collar flange 68 and the second end of the bellows. The flexible nature of the material forming the bellows 52 allows the collar 68 to be fitted through the second opening 40 by elastic deformation of the bellows, without requiring the use of tools, which facilitates the fastening of the sealing system 50 to the box 20.

Figure 4:
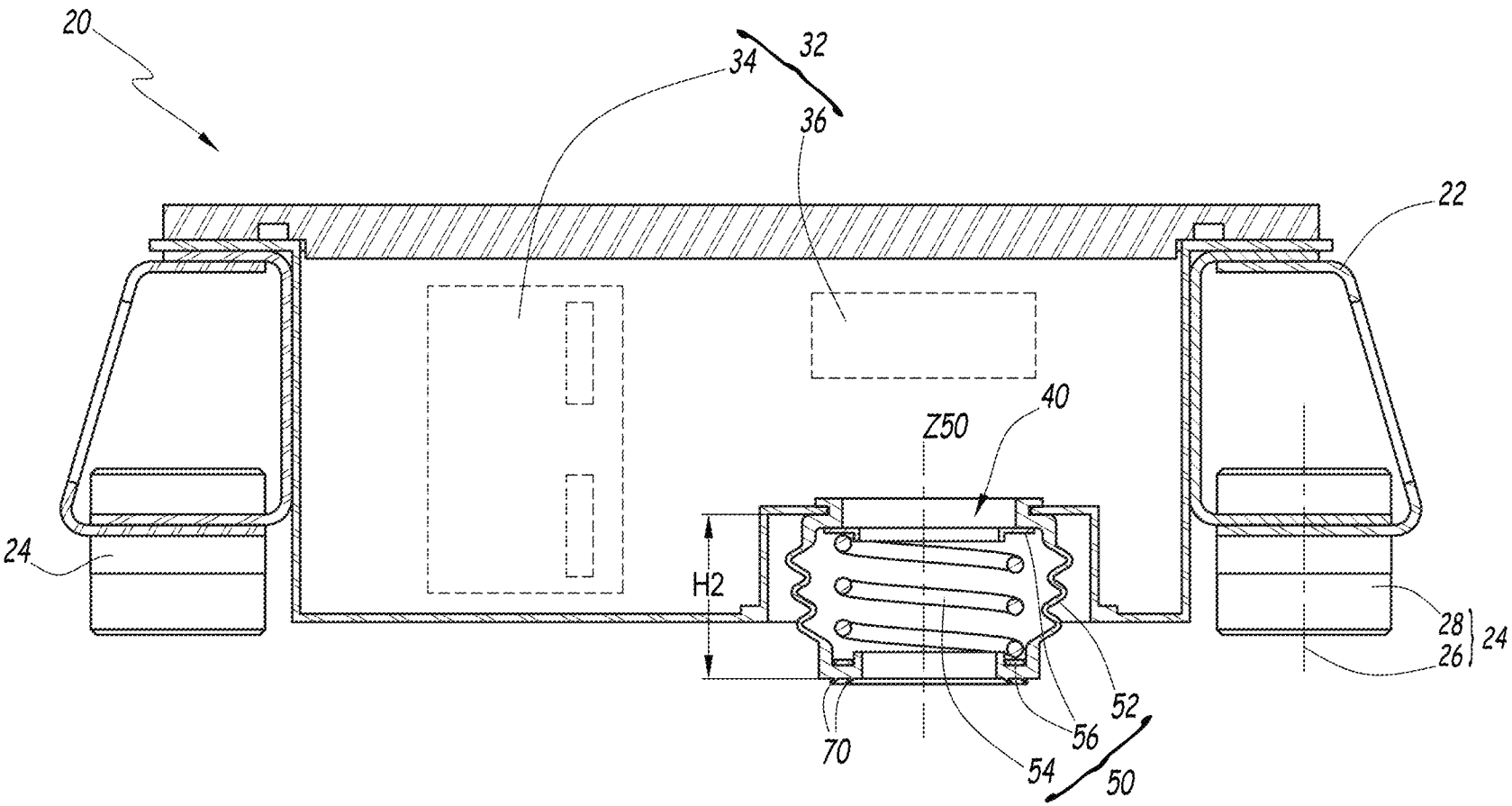
FIG. 4 is a section similar to FIG. 2, of a box according to the invention, the box belonging to the vehicle shown in FIGS. 1 to 3 and comprising a sealing system according to the invention.

In FIG. 4, the box 20 and the sealing system 50 are shown alone, without the body 12 of the vehicle 10. The box 20 and the sealing system 50 then form an assembly intended for being fastened to the body of a vehicle. In such configuration, the first end 60 of the bellows 52 is fastened to the edge 41, the second end 62 of the bellows is not in contact with anything, and the forces F1 and F2 exerted by the compression spring 54 then move the second end of the bellows away from the first end 60 of the bellows, thereby relaxing the compression spring, until a state of equilibrium is reached. The sealing system 50 is then in the rest configuration. H2 denotes the height, measured along the axis Z50 in the rest configuration and separating the two ends 60 and 62 of the bellows 52.

When the box 20 equipped with the sealing system 50 is fastened to the body 12 of the vehicle 10, like in FIGS. 1 to 3, then the first end 60 of the bellows 52 bears against the body 12, more precisely with the roof 18, so as to surround the first opening 38, and the sealing system is in the mounting configuration.

In addition, the height H1 of the passage 42 is shorter than the height H2 separating the two ends 60 and 62 of the bellows 52 when the sealing system 50 is in the rest configuration. Thereby, in the mounting configuration, and as can be seen more clearly in FIG. 3, the sealing system is compressed between the body 12 and the box 20 until the height separating the two ends 60 and 62 of the bellows is equal to the height H1 of the passage 42. In other words, in the mounting configuration of the sealing system 50, the spring 54 is compressed. The compression of the spring 54 leads to an increase in the forces exerted by the spring on the two ends 60 and 62 of the bellows, by means of the washers 56, and thereby leads to the first end 60 being pressed against the body 12 and the second end 62 being pressed against the box 20.

In other words, the ends 60 and 62 of the bellows 52 are not simply in contact with the body 12 and the box 20, but are held pressed, i.e. compressed, against the body and the box, by the compression spring 54. In practice, in the mounting configuration, the forces F1 and F2 exerted by the compression spring on the ends of the bellows are comprised between 50 N and 500 N, preferentially equal to 200 N.

The compression of the ends of the bellows against the body and the box is particularly advantageous, because the compression enhances the sealing provided by the bellows 52, i.e. that the compression reduces the risks of infiltration and splashing of water from the gap 30 towards the passage 42.

Furthermore, the compression also makes it possible to tolerate defects of planarity of the roof 18 and/or of the structure 22, as well as of the deteriorated surface states of the elements, presenting e.g. defects such as striations or material tears, without reducing the sealing [efficiency] of the sealing system 50. Indeed, the contact pressure generated by the compression of the ends of the bellows 52 by the compression spring 54, associated with the flexibility of the bellows, compensates for such defects.

The sealing system 50 also tolerates defects of coplanarity between the first opening 38 and the second opening 40, since the spring 54, when compressed, is apt to deform perpendicularly to the axis Z50, e.g. by bending, and such deformation of the spring leads to a similar deformation of the bellows 52.

Moreover, the passage 42 is sealed regardless of the shape of the openings 38 and 40, as long as the openings are entirely surrounded by the bellows 52.

Due to such multiple advantages, the vehicle 10 is less expensive to manufacture, since the manufacturing requirements for the body 12 and for the structure 22 of the box 20 are reduced.

In the example, the compression spring 54 is arranged inside the bellows 52. Thereby, the spring is accessible from the passage 42, but is not accessible from the outside of the vehicle 10, and in particular from the gap 30. Such arrangement is particularly advantageous, both in order to prevent the compression spring from coming into contact with water, which could lead to damaging the spring, especially when same is made of spring steel, and to a good compression of the concertina wall 58 of the spring 54. Indeed, the compression of the concertina wall 58 generally takes place by an increase in the width of the bellows, radially to the axis Z50, whereas the width of the compression spring is generally constant. Moreover, the fact that the compression spring is arranged inside the bellows 52 enables the sealing system 50 to form an integral, easy to transport assembly, since the spring is held inside the bellows by the ends 60 and 62 of the bellows, as well as by the washers 56. In practice, the sealing system 50 is assembled by positioning the washers 56 on the two ends 62 and 64 of the compression spring 56 and then the bellows 52 is fitted around the spring and the washers, by elastic deformation.

Advantageously, the first end 60 of the bellows 52 comprises at least one sealing rib 70, in the example two sealing ribs 70 which are compressed against the body 12. The sealing ribs 70 improve the sealing between the first end of the bellows and the body by reducing the contact surface between the first end of the bellows and the body, thereby increasing the contact pressure at the contact surface.

In FIG. 3, for an easier representation the sealing ribs are shown in the rest configuration thereof. In practice, in the mounting configuration of the sealing system 50, the sealing ribs 70 are deformed until being compressed between the first end 60 of the bellows 52 and the body 12.

Advantageously, the roof 18 of the body 12 comprises a flange 72 which extends from the edge 39 along the axis Z10, moving away from the interior volume V12 of the body, i.e. extending into the passage 42. The flange 72 thereby extends inside the sealing system 50, and more precisely inside the first end 60 of the bellows 52. The flange 72 thereby positions the first end of the bellows around the first opening 38, preventing the first end of the bellows from sliding radially to the axis Z10.

A method of assembly the vehicle 10 is now described, aimed at assembling the box and the sealing system 50 on the body 12.

In a preliminary step, the sealing system 50 is fastened to the box 20 using the fasteners 68.

In a first step of the method of assembly, the box 20 and the sealing system 50 are positioned on the body 12, so that the second opening 40 is opposite the first opening and so that the sealing system surrounds the passage 42, i.e. the first end 60 of the bellows 52 is in contact with the body and the second end 62 of the bellows is in contact with the box.

During the first step of the method of assembly, the bellows 52 is further arranged so that the first end 60 of the bellows surrounds the flange 72 of the body 12. Thereby, the flange 72 facilitates the correct positioning of the bellows 52.

In a second step of the method of assembly, the box 20 is fastened to the body 12 using the fasteners 24. During such step, the compression spring 54 is compressed, until the sealing system 50 changes from the rest configuration thereof to the mounting configuration thereof. In the example, such compression of the spring 54 is forced when the screws 26 are screwed in and the shock absorbing bushings 28 are compressed. Moreover, when the axes Z10 and Z50 coincide and when the box 20 is arranged above the body 12, like in the example, then compression of the spring 54 is enhanced by the weight of the box 20. It should be understood that during the second step, no intervention by an operator on the sealing system 50 is required.

At the end of the second step, the sealing system provides the sealing between the passage 42 and the gap 30, by means of the bellows 52, the ends 60 and 62 of which are pressed against the body 12 and against the box 20, since the compression spring 54 separates the two ends of the spring from each other and provides a contact pressure between the bellows and the body and the box.

It should be understood that, in the example described herein, the sealing system 50 is not fastened to the body 12 and is held in position against the body only due to the action of the compression spring 54 which presses the first end 60 of the bellows against the body. Thereby, by means of the compression spring 54 which provides a high contact pressure between the bellows 52 and the body 12, the bellows does not have to be fastened to the body prior to the assembly of the vehicle 10. Such feature is in contradiction with the prejudices of the field, according to which the bellows would necessarily be fastened to the vehicle body, e.g. by means of a flange or of a clamp. Furthermore, such feature is particularly advantageous for making safe the method of assembly of the vehicle 10, since it is thereby not necessary to fasten the sealing system 50 to the body 12. However, such a fastening would have to be carried out before fastening the box 20 to the body, but after the box has been positioned above the body, i.e. such a fastening would have to be carried out under a load being lifted, which is particularly dangerous.

Furthermore, the fact that the sealing system 50 is not fastened to the body 12 makes possible a relative movement of the sealing system with respect to the body, which is advantageous for reducing the mechanical stresses exerted on the sealing system, e.g. when the sealing system undergoes significant vibrations.

In a variant of the invention (not shown), the sealing system 50 is not fastened to the box 20 beforehand but is fastened beforehand to the roof 18 of the body 12. Thus, in such a variant, the fasteners 68 cannot be used for fastening the second end 62 of the bellows 52 to the edge 41 of the structure 22, but can be used for fastening the first end 60 of the bellows to the edge 39 of the body 12. Moreover, in such a variant, the method of assembly of the vehicle 10 is similar to the method described hereinabove. Preferentially, in such a variant, the structure 22 of the box 20 comprises a flange, similar to the flange 72, which facilitates the positioning of the box 20 with respect to the sealing system 50. Preferentially, in such a variant, the second end 62 of the bellows 52 comprises sealing ribs, similar to the sealing ribs 70, which are compressed against the box 20. Like in the embodiment shown in the figures, the method of assembly of a vehicle 10 according to such variant does not require any intervention under a load being lifted.

In a variant of the invention (not shown), the sealing system 50 does not comprise fasteners 68. Thereby, in such a variant, the sealing system is neither fastened to the box nor fastened to the body 12. In such a variant, the method of assembly of the vehicle 10 is similar to the method described hereinabove, and during the first step, the box 20 and the sealing system 50 are positioned on the body 12 one after the other. In practice, the sealing system is first positioned on the body, then the box is positioned on the sealing system and on the body. Preferentially, in such a variant, the first end 60 of the bellows 52 comprises sealing ribs 70 which are compressed against the body 12, and the second end 62 of the bellows comprises sealing ribs similar to the sealing ribs 70, which are compressed against the box 20. Preferentially, in such a variant, the body 12 and the box 20 each comprise a flange 72, so as to facilitate the positioning of the sealing system 50 on the body, then the positioning of the box on the sealing system and on the body. Furthermore, at the end of the second step of the method of assembly, the assembly system 50 is held both against the body 12 and against the box 20 due to the action of the compression spring 54 which presses the ends 60 and 62 of the bellows against the body and against the box. Like in the embodiment shown in the figures, the method of assembly of a vehicle 10 according to such variant does not require any intervention under a load being lifted.

In a variant of the invention (not shown), the fasteners 68, whether same are used for fastening the bellows 52 to the box 20 or to the body 12, is a flange, held in place by means of screws which are screwed into the edge 39 or into the edge 41, or are a clamp which is clamped around a protrusion with a shaped matching the box or the body.

In a variant of the invention (not shown), the sealing system 50 does not comprise any washers 56, and the ends 64 and 66 of the compression spring 54 act directly on the ends 60 and 62 of the bellows 52.

In a variant of the invention (not shown), the spring 54 is not arranged inside the bellows 52, but is arranged outside the bellows 52, or is integrated into the bellows 52, e.g. by overmolding, i.e. the bellows 52 and the spring 54 together form a one-piece subassembly.

In a variant (not shown), the railway vehicle 10 could be composed of a plurality of cars, each with a body 12 equipped or not equipped with a box. In a variant (not shown), the vehicle 10 is a tram, or a road vehicle such as a coach, an air transport vehicle, or even a sea transport vehicle.

Any feature described in the foregoing for one embodiment or one variant, can be implemented for the other embodiments and variants described hereinabove, provided that it is technically feasible.

What is claimed is:

1. An assembly intended for being fastened to a body of a vehicle, the vehicle body comprising a first opening, wherein the assembly comprises a box and a sealing system fastened to the box, wherein the box comprises a second opening delimited by an edge, the box being intended for being positioned on the body in such a way that the first opening and the second opening face each other and form a passage between inside of the body and inside of the box, the sealing system being configured for surrounding the passage, wherein the sealing system comprises a bellows having a first end configured for being in contact with the body so as to surround the first opening, and a second end, in contact with the box so as to surround the second opening, wherein the sealing system comprises a compression spring extending along an axis and having two ends, each of the two ends of the compression spring acting on one of the first end and second end of the bellows so that the compression spring moves the first end and the second end of the bellows apart, along the axis, and wherein the bellows comprises fasteners, the second end of the bellows being fastened by the fasteners to the edge delimiting the second opening.

2. The assembly according to claim 1, wherein the sealing system comprises two washers, each washer being held between one of the two ends of the compression spring and one of the first end and the second end of the bellows.

3. The assembly according to claim 1, wherein at least one of the first end and second end of the bellows comprises at least one sealing rib intended for being compressed against the body or against the box.

4. The assembly according to claim 1, wherein the spring is arranged inside the bellows.

5. The assembly according to claim 1, wherein the spring has a stiffness comprised between 1,000 N/m and 10,000 N/m.

6. The assembly according to claim 1, wherein the fasteners are a peripheral collar flange extending through the second opening so as to hold the edge between the collar flange and the second end of the bellows.

7. A vehicle, comprising:

a body having a first opening;

a box having a second opening, the box being fastened to the body and positioned on the body in such a way that the first opening and the second opening face each other and form a passage between inside of the body and inside of the box; and a sealing system surrounding the passage, wherein the box and the sealing system form an assembly according to claim 1, and wherein the box is fastened to the body so as to compress the compression spring between the box and the body, the compression spring pressing the first end of the bellows against the body and pressing the second end of the bellows against the box.

8. The vehicle according to claim 7, wherein the compression spring exerts forces on each of the first end and second end of the bellows, comprised between 50 N and 500 N.

9. The vehicle according to claim 7, wherein the vehicle is a railway vehicle.

10. A method of assembly a vehicle, in particular a railway vehicle, the vehicle comprising:

a body having a first opening;

a box having a second opening; and a sealing system, wherein the box and the sealing system form an assembly according to claim 1, wherein the method of assembly of the vehicle comprises:

a) fastening the sealing system to the box, using the fasteners, b) positioning the box on the body and positioning the sealing system between the box and the body, so as to: arrange the second opening opposite the first opening; surrounding a passage between the two openings, by the sealing system; and putting the first end of the bellows in contact with the body and the second end of the bellows in contact with the box, then c) fastening the box to the body, leading to the sealing system to be held in position between the box and the body by compressing the compression spring thereof.

11. The assembly according to claim 1, wherein the spring has a stiffness equal to 5,000 N/m.

12. The assembly according to claim 7, wherein the compression spring exerts forces on each of the first end and second end of the bellows equal to 200 N.

* * * * *